United States Patent [19]

Goldman

[11] 4,195,950

[45] Apr. 1, 1980

[54] SHOCK ABSORBING STRUCTURE AND METHOD FOR OFF SHORE JACK-UP RIGS

[76] Inventor: Jerome L. Goldman, 225 Baronne St., New Orleans, La. 70130

[21] Appl. No.: 934,610

[22] Filed: Aug. 17, 1978

[51] Int. Cl.[2] ..... E02B 17/08

[52] U.S. Cl. ..... 405/195; 248/601; 405/196; 405/211

[58] Field of Search ..... 405/197, 204, 206, 208, 405/224, 227, 188, 203, 195, 196, 211; 61/87-104; 248/2, 13, 24

[56] References Cited

U.S. PATENT DOCUMENTS

| | | | |
|---|---|---|---|
| 3,575,288 | 4/1971 | Brucken | 248/24 |
| 3,693,363 | 9/1972 | Van Den Kronenberg | 405/201 |

*Primary Examiner*—David H. Corbin
*Attorney, Agent, or Firm*—C. Emmett Pugh & Associates

[57] ABSTRACT

A new and improved shock absorbing structure and method for use on a jack-up off-shore drilling rig is disclosed. The shock absorbing structure is designed for mounting on the bottom of each existing leg of the drilling rig and comprises a novel bottom member fixedly attached to each leg with the bottom member having a piston member positioned in the central portion thereof. The piston member is associated with at least one compression member formed around the piston member with the compression member being designed to absorb shock during a shock absorbing condition on the drilling rig leg. The compression member is fixedly attached to the bottom member by retaining means thereby making the structure self contained.

Also disclosed is a new and novel method utilizing the shock absorbing structure on a jack-up off-shore drilling rig.

18 Claims, 6 Drawing Figures

SHOCK ABSORBING STRUCTURE AND METHOD FOR OFF SHORE JACK-UP RIGS

BACKGROUND OF THE INVENTION

1. Field of the Invention

This invention relates generally to off-shore drilling rigs and in particular to a new and novel shock absorbing structure and method for utilizing the structure on the bottom legs of a jack-up off-shore drilling rig.

2. General Background and Prior Art

Existing types of jack-up drilling rigs have to be taken off and put back on the ocean floor with their legs being removed or put on the ocean floor in relatively smooth water. In accomplishing this movement, the entire drilling rig structure is moving around with some degree of violence due to the movement of the ocean resulting in the drilling rig legs being subject to severe shock which may result in destruction of the leg and the elevating mechanism that operates the legs vertically up and down.

In attempting to alleviate this problem, many drilling rig operation manuals are written with very strong restrictions on how much movement the vessel can be doing in the way of up and down and sidewards and rolling motion. The many types of motion can cause very severe problems on the drilling rig legs whenever the legs are to be positioned on bottoms that are quite hard, such as a firm sand bottom or a clay bottom. The problem is less severe where the bottom is very mushy and soft since the ocean floor in these places itself acts as a shock absorber.

Attempts at alleviating the problem have been made by using a cushioning material in the way of the jacking mechanisms to absorb the high amounts of energy obtained with the large degree of motions. These solutions were not successful except in a relatively small percent of the time because the amount of energy that can be absorbed in the available mechanisms was very small.

A prior art search of shock absorbing mechanisms resulted in the hereinafter described structures utilizing various schemes, all of which operate on different principles and applications than that of the present invention.

For examples U.S. Pat. No. 3,975,007, issued to W. J. Chorkey on Aug. 17, 1976 teaches the use of an annularly shaped resilient member to couple coaxially positioned shafts and to provide shock absorbtion. Another shock absorbing system is shown in U.S. Pat. No. 3,495,213 issued to G. B. Forbes et al on Mar. 23, 1976. This device utilizes a conical outer housing to protect subsea wellheads and has resilient cushions variously placed to transmit vertical and lateral forces to the wellhead.

U.S. Pat. No. 4,007,914, issued to J. R. Sutton on Feb. 15, 1977 teaches a device, mounted in housings above the water structure, and having a layered shock absorber mounting structure. The U.S. Pat. No. 3,062,014, issued to P. R. Newcomb on Nov. 6, 1962 teaches a device in the form of a collapsable drilling rig with resilient members between sliding sleeves with the resilient members not being for shock absorbtion but rather to provide a protective function for the mast sections contained therein.

U.S. Pat. No. 3,906,736 issued to R. W. Van Houten et al on Sept. 23, 1975 discloses a shock absorbing system for landing heavy masses on subsea oil wellheads using piston type shock absorbers connected to a landing ring by way of clevis assemblies.

U.S. Pat. No. 3,693,363 issued to H. H. Van den Kroonenberg on Sept. 26, 1972 discloses a system for step-by-step horizontal movement of a mobile marine platform in which the supporting leg structure includes an annular inflatable bag in whose center a supplemental leg is vertically and horizontally moved by cylically controlled piston assemblies to effect the horizontal, step-by-step action.

As before mentioned the above prior art patents represent various attempts to solve problems in other non-analogous situations using different solutions than that developed by the applicant.

General Discussion of the Invention

In order to overcome the problems inherent in the various prior art solutions using their various structures and schemes, there has been provided by the applicant's new and novel invention a shcok absorbing structure and method for utilizing the structure which may be used on the bottom of each existing leg of the drilling rig. The shock absorbing structure comprises a bottom member which is fixedly attached to each existing leg of the drilling rig with the bottom member having formed in the central portion thereof a vertically positioned opening into which is fitted an elongated piston member. The piston member has a lower, an intermediate and an upper-end portion with the lower-ebd portion extending below the bottom member during a non-shock absorbing condition and being extendable into the bottom member during a shock absorbing condition.

The shock absorbing structure also comprises at least one compression member formed around the piston member which is designed to absorb shock during a shock absorbing condition with the compression member being associated with the upper-end portions of the piston member and being retained by retaining means fixedly attached to the bottom member.

Accordingly an object and advantage of the invention is to provide a new and novel shock absorbing structure which may be used with existing legs of off-shore drilling rigs and which is able to absorb enormous amounts of energy when utilized without damaging or destroying the drilling rig legs.

Another object and advantage of the invention is to provide a relatively simple shock absorbing structure and method for utilizing the structure which requires a minimum of moving parts and is relatively maintenance free.

These and other objects and advantages of the invention will become apparent from a review of the drawings of the foregoing application and from a study of the description of the shock absorbing structure and method following hereinafter.

DETAILED DESCRIPTION OF THE PREFERRED EMBODIMENT

Figure 1:
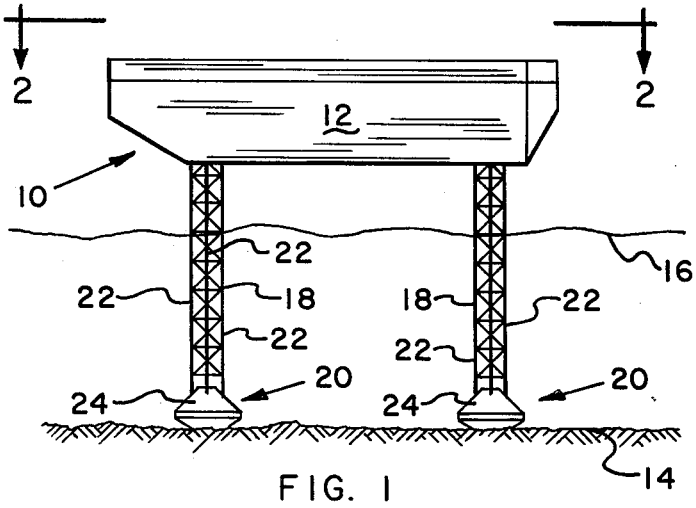
FIG. 1 is an elevational view of a typical off-shore drilling rig structure showing the applicant's shock absorbing structure mounted on the bottom of the existing legs of the structure.
Figure 4:
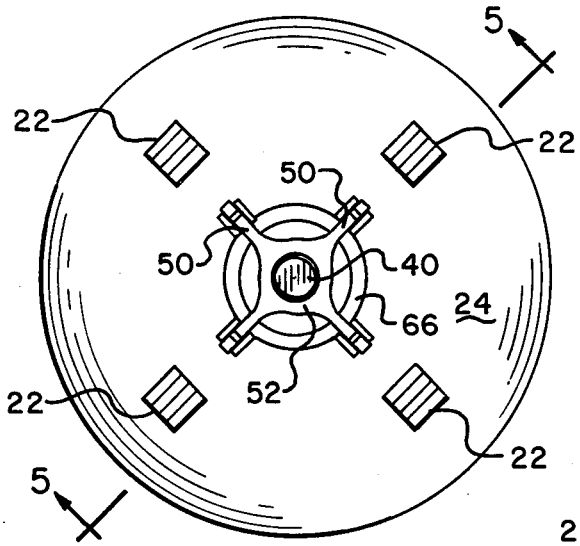
FIG. 4 is a plan cross-sectional view, taken along section lines 4—4 of FIG. 3, showing the spider member with the central hub hereinafter described.

Referring now to the drawings in general and in particular to FIG. 1 of the drawing there is shown an elevational view of a typical off-shore jack-up drilling rig structure (designated generally by the numeral 10) which comprises a platform 12 on top of which is mounted the various drilling and pumping mechanisms used in the drilling rig. The platform 12 is located at a predetermined position on the ocean floor 14 in the water 16 and is retained there by a plurality of jackable legs 18.

In the elevational view of the off-shore drilling rig shown in FIG. 1 there are only two legs 18 shown and it should be noted that the drilling rig platform 12 usually has three or four legs 18 supporting the platform 12.

Figure 2:
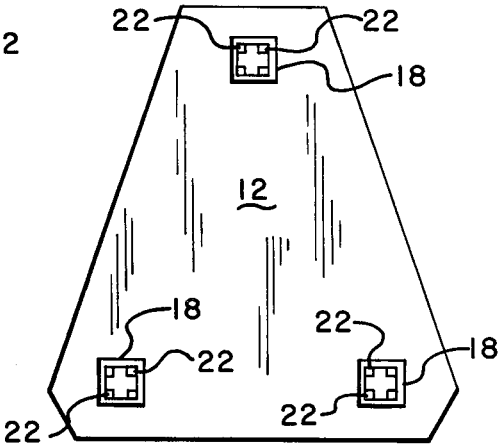
FIG. 2 is a plan view, taken along perspective lines 2—2 of FIG. 1 showing a typical drilling rig platform having three existing legs.

Formed on the bottom of each leg 18 is the shock absorbing structure of the applicant's invention shown generally by the numeral 20 which is fixedly attached to each existing leg as will be hereinafter described. By referring to FIG. 2 of the drawing there is shown a plan view, taken along line 2—2 of FIG. 1, showing a typical drilling rig platform having three existing legs 18. Each leg 18 would comprise a plurality of structural members 22 which are fixedly attached to the applicant's new and novel shock absorbing structure 20 as will be hereinafter described.

Figure 3:
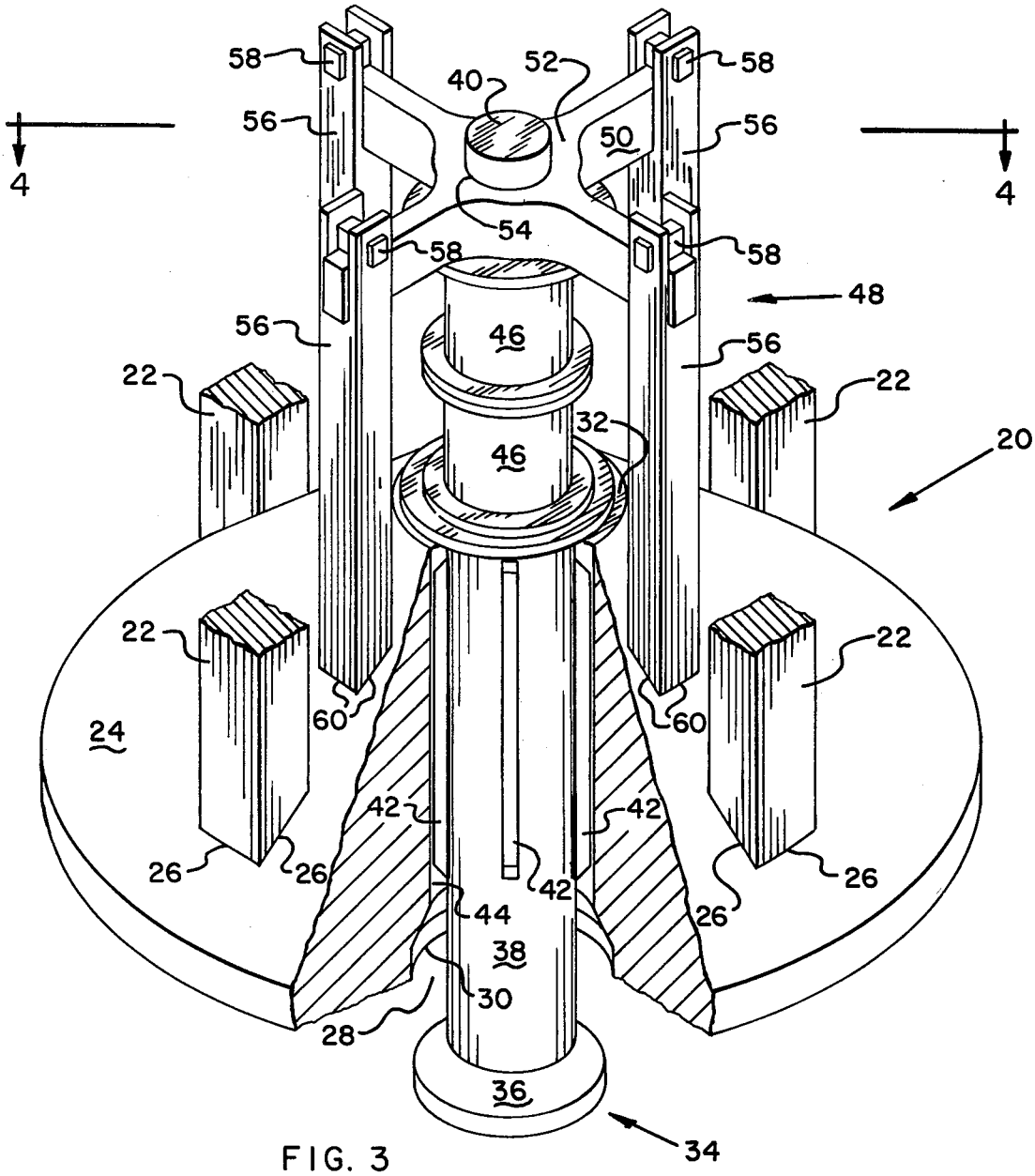
FIG. 3 is a perspective view shown partially in section of the applicant's new and novel shock absorbing structure showing it mounted on the existing legs of an off-shore drilling rig.

Referring now to FIG. 3 of the drawing, there is shown a perspective view shown partially in section of the applicant's new and novel shock absorbing structure 20 showing it mounted on the existing structural member 22 forming the leg 18 as before mentioned. The shock absorbing structure 20 comprises a bottom member 24 formed in a structural configuration as shown which may be solid, partially solid or web construction as desired by the designer.

The structural members 22 may then be welded to the bottom member 24 in the area where the structural member 22 is positioned against the surface of the bottom member 24 as shown by the lines 26.

The bottom member 24 has formed in the central portion thereof a vertically positioned opening 28 extending from the bottom surface 30 to the top surface 32 of the bottom member 24.

Positioned within said vertically positioned opening at 28 is an elongated piston member shown generally by the numeral 34 which comprises a lower portion 36, an intermediate portion 38 and an upper-end portion 40.

The intermediate portion 38 may also have formed thereon a plurality of rubber bumpers 42. It should be observed that the intermediate portion 38 is sized somewhat smaller in diameter than the diameter 44 of the intermediate portion of the bottom member 24. In a like manner the plurality of rubber bumpers 42 are sized so that whenever they are applied to the intermediate portion 38 the elongated piston member 34 is able to move vertically within the bottom member 24 with sufficient play as desired. It is within the spirit and scope of the invention also that the rubber bumpers 42 may also be formed on the intermediate portion diameter 44 of the bottom member 24 and other means may be utilized to provide a metal to metal protection in this area.

The lower end portion 36 of the elongated piston member 34 extends below the bottom surface 30 during a non-shock absorbing condition and may be formed generally larger in diameter than the diameter of the intermediate portion 38. The purpose of this will be described more fully hereinafter when referring to FIGS. 5 and 6 which show respectively a non-shock absorbing condition and a shock absorbing condition of the applicant's new and novel shock absorbing structure 20.

Figure 5:
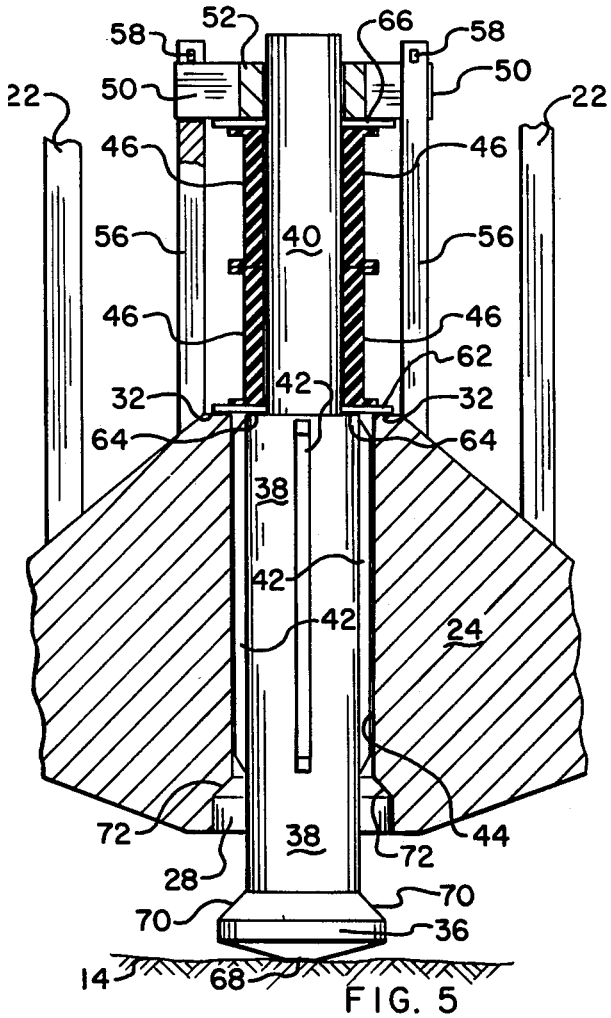
FIG. 5 is a sectional view, taken along section lines 5—5 of FIG. 4, showing the elongated piston member of the shock absorbing structure in its initial pre-shock absorbing disposition.

Formed around the elongated piston member 34 in the area of the upper portion 40 is at least one compression member 46 which may be formed in a spool like configuration as shown in FIG. 3 and also as better shown in FIG. 5 of the drawing. In a more preferred embodiment of the invention, there are utilized two compression members 46 however it is within the spirit and scope of the invention that at least one compression member may be used and also that more than two compression members may be used as desired by the structural designer of the shock absorbing system.

Associated with and surrounding the upper end portion 40 is a retaining means shown generally by the numeral 48 which retains the upper end portion 40 of the elongated piston member 34 from horizontal movement during a shock absorbing condition. The retaining means comprises in part a four leg spider member 50 having a central hub 52 which has formed therein an elongated opening 54 to which is positioned the upper end portion 40.

Each leg of the spider member 50 is positioned within a U-shaped slot formed in a tension post 56. The legs of the spider member 50 are then locked in the U-shaped slot by means of a rigid locking bar 58 which is positioned within an opening in the U-shaped slot formed in the tension post 56.

The tension posts 56 are elongated in shape and have their ends, that are opposite to the end connected to the legs of the spider member 50, fixedly attached to the bottom member 24 at the areas shown by the numeral 60. The tension post, as well as the other various members of the shock absorbing structure, with the exception of the rubber of resilient parts, are generally fabricated of structural steel and may also be fabricated of other means within the spirit and scope of the invention.

The compression member 46 as well as bumpers 42 may be formed of rubber or some other resilient material and may be designed to have sufficient compressive strength as necessary by the conditions to which the structure is to be exposed.

Referring now to FIG. 5 of the drawing, there will be shown how the compression member or members 46 are positioned around the upper end portion 40 of the elongated piston member 34 and how they are grounded or retained from motion at one end on said intermediate portion 38 and how they are grounded or retained at the other end on said retaining means 48. When using two compression members 46 as shown in FIG. 5, it will be noted that there is positioned a plate 62 which is positioned on the top surface 32 of the bottom member 24 as well as on the surface 64 formed by means of the difference in diameters between the upper portion 40 and the intermediate portion 38. When positioned thusly, the spool like compression member 46 is positioned around the upper portion 40 and rests on the top surface of plate 62.

On top of the first compression member 46 would be positioned a second compression member 46 as shown in FIG. 5 of the drawing, and it will then be noted that there is a plate 66 positioned around the upper portion 40 between the top compression member 46 and the central hub 52 of the retaining means 48.

It can then be seen that the compression member or members 46 are positioned between the central hub 52 and its plate 66 and the bottom member 24 and its plate 62. By referring now to FIG. 6 of the drawing, there is shown a view similar to FIG. 5, showing the elongated piston member 34 in a shock absorbing condition with the compression member or member 46 being shown partially compressed and absorbing the shocks on the system. When in the shock absorbing condition as shown in FIG. 6, the compression member or members 46 then are utilized to take the vertical shock encountered by the elongated piston member 34 as the extreme lower end 68 thereof strikes the ocean floor 14 or some submerged object such as a large boulder or a submerged wreck.

Figure 6:
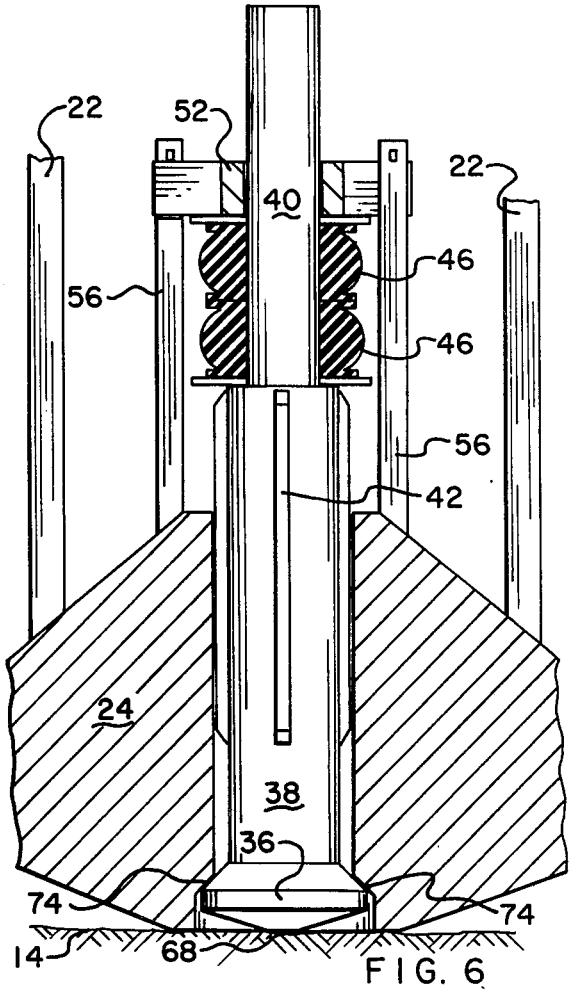
FIG. 6 is a view similar to FIG. 5 showing the elongated piston member of the shock absorbing structure in a shock absorbing condition with the compression member shown partially ccmpressed and absorbing the shocks.

The lower portion 36 may be designed in the shape shown in FIGS. 3, 5 and 6 and having a sloped surface 70 designed to match with a sloped surface 72 formed in the bottom member in vertically positioned opening 28. When formed thusly, as shown in FIG. 6, the two matched sloped surfaces 70 and 72 would form a metal to metal contact area at the position shown by the numeral 74 at which time the lower portion 36 would be positioned within the vertical position opening 28 and maximum compressive forces would be absorbed by the system utilizing the compression member or members 46.

These compression members 46 actually look like two oversized rope drum wheels or enormous sewing thread spools made of rubber. However it is within the spirit and scope of the invention that the compression members 46 may be formed in some other configuration without departing from the spriit and scope of the invention. When formed in the shape shown in the drawing figures, the size of each compression member 46 would be roughly twelve feet in diameter having a hollow cylindrical opening. They may be threaded on the upper portion 40 by threading means forming no portion of the present invention and may also be positioned and retained on the upper portion 40 by other means within the spirit and scope of the invention. In the preferred form of the invention, it will be noted that the bottom member 24 is formed in a circular configuration however it could also be formed in other configurations as desired by the structural designer.

When the new and novel shock absorbing structure 20 is utilized to protect existing legs of an off-shore ocean type drilling rig, the legs would be protected by providing each leg with a shock absorbing structure on the lower portion thereof. Into the shock absorbing structure would be provided the vertical piston member in the central portion thereof and at least one compression absorbing member would be positioned around the piston member to absorb the shocks. Whenever it is desired to raise or lower the leg of the off-shore drilling rig, the shock absorbing structure would function to allow the piston members and the compression absorbing members to absorb shocks as the legs hit the bottom surface of the ocean or some submerged item. As a result the legs of the rig would be protected against damage. From this it can be seen that the method utilizes the new and novel shock absorbing structure as herein described and it can be seen that enormous amounts of energy can be absorbed by use of the compression member or members 46 of the applicant's structure.

When raising or lowering the legs of the drilling rig, it is generally the practice to raise or lower the legs all at the same time. However there is not sufficient precision in the lowering and raising system to assure that each leg will go up or down at exactly the same time. As a result the legs can touch the bottom surface at different times.

In raising the legs they can also be brought up and retracted at different times and it is common to have two legs come free from the ocean floor while the third leg sticks resulting in two of the legs being moved upwardly a short distance with an effort being made to loosen and raise the third leg.

From the foregoing it can be seen that there has been provided by the subject invention a new and novel shock absorbing structure and method for use on a jack-up off-shore drilling rig which accomplishes all of the objects and advantages of the invention as hereinbefore described including the protection of the existing legs of the drilling rig. It should become apparent that many changes may be made in the various arrangement of parts and the various structural parts of the applicant's new and novel structure and also in the steps of the method without departing from the spirit and scope of the invention. The description of the shock absorbing system and structure hereinbefore detailed is given by way of illustration only and the applicant is not to be limited in his patent to the exact structure shown and detailed.

For example, a hydraulic shock absorbing device can be substituted for the rubber or elastic material indicated in the drawings. Additionally, rather than circular, the bottom can be for example polygonal.

Having described my invention, I claim:

1. A shock absorbing structure for use on the bottom of at least one support leg of an off-shore rig, which is supported above the water surface by at least one vertically movable leg, comprising:

(a) bottom member means fixedly attached to the bottom portion of the leg of the rig for load supporting of the upper portion of the rig when the rig is set and held up in position from the water bottom;

(1) said bottom member means having formed in a portion thereof an opening;

(b) an elongated vertically movable piston member positioned within said opening and having a lower, and intermediate and an upper end portion, (1) said lower end portion always resiliently extending below the lowermost portion of said bottom member means when said bottom member means is out of contact with the water bottom;

(c) at least one compression member means associated with said piston member, for absorbing shock during a shock absorbing condition when the leg is initially lowered into contact with the water bottom, said piston member being the first substantial structure to resiliently contact the water bottom; and (d) retaining means, associated with said upper end portion, for retaining and limiting the movement of said upper end portion, (1) said retaining means being fixedly attached to said bottom member means, said compression member means and said retaining means allowing said piston member to vertically move upwardly with resilient resistance under the action of the water bottom contact allowing said bottom member means to ultimately contact the water bottom and carry the load.

2. The shock absorbing structure as defined in claim 1 wherein said bottom member means is formed in a circular or polygonal shape.

3. The shock absorbing structure as defined in claim 1 wherein said elongated piston has formed, above said lower end portion, an intermediate portion and has above said intermediate portion, said upper end portion.

4. The shock absorbing structure as defined in claim 3 wherein said at least one compression member means is positioned around said upper end portion and is grounded at one end on said intermediate portion and is grounded at the other end on said retaining means.

5. The shock absorbing structure as defined in claim 4 wherein said at least one compression member means comprises at least two compression members positioned one on top of the other.

6. The shock absorbing structure as defined in claim 5 wherein said compression members are formed of rubber or other shock absorbing material.

7. The shock absorbing structure as defined in claim 1 wherein said retaining means comprises in part a spider member having a central hub, said hub having formed therein an elongated opening positioned around said upper end portion.

8. The shock absorbing structure as defined in claim 7 further comprising said retaining means comprising in part a plurality of tension posts rigidly locked in place to said spider member.

9. The shock absorbing structure as defined in claim 8 wherein said plurality of tension members are rigidly fixed to said bottom member means.

10. The shock absorbing structure as defined in claim 1 further comprising a plurality of bumpers being positioned on said intermediate portion.

11. The shock absorbing structure as defined in claim 10, wherein said bumpers are formed of rubber.

12. The shock absorbing structure as defined in claim 1 wherein said piston member includes on an upper side an angled surface off both the vertical and the horizontal and said bottom member means has on a lower side a like angled surface positioned vertically opposite the first angled surface, said two angled surfaces contacting each other in face-to-face engagement when said piston member is moved upwardly into its inner-most position within said bottom member means.

13. A method for protecting the leg of an off-shore jack-up type rig wherein the rig is supported from the water bottom to above the water surface on one or more legs, comprising the steps of:

(a) including on at least one leg a shock absorbing structure on the lower portion of the leg;

(b) including at least one compression absorbing member with a vertically movable piston and a shock absorbing, compression absorbing member for each shock absorbing structure to absorb shock;

(c) lowering the leg with the shock absorbing structure attached onto the water bottom, and (d) allowing the compression absorbing member, to absorb the shocks as the leg comes into contact with the water bottom by allowing said piston to move against and compress said shock absorbing, compression absorbing member, thereby protecting the leg against damage.

14. The method as defined in claim 12 wherein in step "b" there is further included the step of providing a vertically movable piston and a resilient element compression absorbing member; and in step "d" there is included the step of allowing said piston to move against and compress said resilient element to thereby absorb the shocks.

15. The method of claim 12 wherein there is included the further steps of repeating steps (a) through (d) inclusive for each leg of the rig.

16. The method of claim 12 wherein there is further included the step of including for each shock absorbing structure an encircling bottom member fixedly attached to the leg and having a relative large bottom surface area in comparison to said shock absorbing structure, and wherein in step c) the bottom member is allowed to ultimately carry substantially all of the load applied to the leg to which it is attached after said shock absorbing structure initially absorbs the shock of initial ground contact and the leg is set down for long term support unto the water bottom.

17. The method of protecting a support leg of an off-shore, jack-up type rig wherein the rig is supported from the water bottom above the water surface on one or more of such support legs, which support leg is lowered down into engagement with the water bottom and ultimately supportively engages the water bottom and supports at least in part the rest of the rig, comprising the steps of;

(a) including on the lower portion of the support leg a relatively rigid bottom member means rigidly attached to the support leg for load supporting of the rig when the rig is set and held up in position from the water bottom and a resilient shock absorbing means associated with said bottom member means and resiliently attached to the leg for relative vertical movement therewith under resilient resistance for resiliently absorbing without failure the initial shock of the support leg's initial contact with the water bottom;

(b) having the lower-most portion of said resilient shock absorbing means extending further down past at least the lowermost portion of the regular load bearing portion of said bottom member means before said bottom member means is ever in contact with the water bottom so that said shock absorbing means is the first substantial structure which initially meets with the water bottom and resiliently absorbs the initial water bottom contact shock and impact; and (c) upon contact between the shock-absorbing means and the water bottom, allowing the lower-most portion of said resilient shock absorbing means to movve-up with resilient resistance against the impact until ultimately the permanent load bearing portion of said bottom member means is in load supporting contact with the water bottom.

18. The method of claim 17 wherein said resilient shock absorbing means includes a vertically movable piston member attached to the leg through at least one resilient compressive member positioned between two rigid members, one fixed to said piston member and the other to the leg, and wherein step (c) includes the step of allowing said vertically movable piston member to move up against the resilient resistance of said compressive member.

* * * * *